United States Patent [19]

Rostvold

[11] 4,430,056

[45] Feb. 7, 1984

[54] PRESSURE ACTUATED SEAL FOR TRAVELLING GRATE

[75] Inventor: Virgil C. Rostvold, Nashwauk, Minn.

[73] Assignee: The Hanna Mining Company, Cleveland, Ohio

[21] Appl. No.: 358,643

[22] Filed: Mar. 16, 1982

[51] Int. Cl.[3] ..... F27B 9/26; F27D 1/18; C21B 7/16

[52] U.S. Cl. ..... 432/137; 266/179; 432/242

[58] Field of Search ..... 432/137, 242; 266/178, 266/179

[56] References Cited

U.S. PATENT DOCUMENTS

| | | | |
|---|---|---|---|
| 2,174,066 | 9/1939 | Ahlmann | 432/137 |
| 2,485,422 | 10/1949 | Urban | 266/179 |
| 3,322,414 | 5/1967 | Boron | 266/178 |
| 3,713,634 | 1/1973 | Moller et al. | 266/179 |

*Primary Examiner*—John J. Camby

*Attorney, Agent, or Firm*—Maky, Renner, Otto & Boisselle

[57] ABSTRACT

A pressure actuated sealing system for a travelling grate comprising at least one horizontally elongated rigid seal plate pivotally mounted below said travelling grate in sealing relationship with said travelling grate and with windbox means mounted below said travelling grate, said travelling grate including a plurality of pallets each with seal plate engaging means and cavity means provided on the underside thereof, said seal plate being pivotable in the direction of movement of said travelling grate by engagement with said seal plate engaging means, said seal plate being pivotable in the direction opposite the direction of movement of said travelling grate by the pressure differential across said seal plate formed by the pressure of the gases within said wind box means on one side of said seal plate and the ambient pressure on the other side of said seal plate, said cavity means being adapted for permitting unobstructed pivotal movement of said seal plate in said opposite direction.

26 Claims, 4 Drawing Figures

PRESSURE ACTUATED SEAL FOR TRAVELLING GRATE

TECHNICAL FIELD

This invention relates to travelling grates and, more particularly, to sealing systems for use with travelling grates. Specifically, the invention is directed to a pressure actuated sealing device for use with travelling grates.

BACKGROUND OF THE INVENTION

Horizontal travelling grate pelletizing machines and certain types of grate kilns are widely used in the preparation of finely divided pelletizable materials, such as pelletized iron ore. A typical horizontal travelling grate pelletizing machine includes a travelling grate which consists of an array of a plurality of edge abutting slotted pallets that travel along a straight horizontal track to define a continuous material carrying grate with a gas permeable bottom. In a typical iron ore pelletizing operation moist spherical agglomerates of an iron ore filter cake with a nominal diameter of, for example, about one-half inch (termed "green balls") are deposited in a layer or bed of predetermined thickness at the charging end of the grate. The green balls are subjected to drying, high temperature heating, and cooling as the grate moves through several zones of the pelletizing machine. The green balls are completely heat hardened and cooled before being discharged from the grate as product. These treatments involve passing air in the cooling zone and hot gases in other zones through the bed of green balls on the grate, either in down draft or up draft or in a combination of down draft and up draft gas flows. Windboxes are usually positioned below the grate for receiving and transmitting the air and the hot gases.

A typical grate kiln type of pelletizing machine includes a straight travelling grate having a gas permeable bottom and upwardly extending confronting side walls, the grate usually being a chain grate. Green balls are deposited on the grate and travel on the grate through drying and preheating zones which partially harden the balls; the partially hardened balls are discharged from the grate into a rotary kiln that rotates about an axis that is inclined downwardly from its receiving end to its discharge end. The heat hardening is completed in the rotary kiln after which the balls pass through a cooler. Hot combustion gases are introduced into the rotary kiln at its discharge to complete the heat hardening of the balls as they tumble in the rotary kiln. Hot gases also pass one or more times through the balls on the grate in the drying and preheating operations. Windboxes are mounted below the grate for receiving and/or transmitting the hot gases.

Each of the foregoing types of equipment usually has an open area between the windboxes and the travelling grate at the charge and discharge ends of the grate. These open areas are a source of heat loss due to the penetration of external air or the escape of hot gases. With the ever increasing costs of fuel to operate equipment of this type it is essential that these open areas be sealed as well as practicable. Attempts have been made to seal these open areas. For example, fixed sealing plates or dead plates have been arranged adjacent the end windboxes with as little clearance as possible to the underside of the pallets passing over the sealing plate. However, with fixed sealing plates of this type the problem of jamming of the pallets thereon exists. In order to avoid jamming the plates have been designed to flex downwardly away from the pallet. A spring type mounting has been used to provide such flexing. However, such flexibly mounted sealing plates have not been entirely adequate in preventing penetration of excess air into or escape of gases from the end windboxes. In addition, the spring mounted plates have a tendency to move laterally with respect to the pallets and thereby open more excape areas for the gases. Another variation of such plates includes the use of beds of granular material maintained at an appropriate level by scraping action of the pallet cross members.

U.S. Pat. No. 3,713,634 describes a sealing device for use with travelling grates that includes two sealing plates arranged one behind the other in the direction of travel of the pallets of the travelling grate, each of the sealing plates extending over at least two pallet cross-supports. This structure includes a lever which is pivotally supported at an intermediate point thereof to the machine structure, one end of the lever being pivotally secured to the sealing plate. The lever is provided with a counterweight for urging the sealing plate in the direction of the pallets.

U.S. Pat. No. 3,719,354 discloses the use of dead plates extending over the width of a travelling grate at the positions wherein the pallets enter and leave the treatment zone of a grate kiln. Each of the pallets have wear strips depending from the underside of the leading and trailing ends thereof which contact the dead plates as they pass thereover. The wear strips are formed of a material that is softer than the dead plates, whereby the wear strips are worn away to accommodate for distortion of the pallets.

It would be advantageous to provide a sealing system for grate kilns and the like employing a travelling grate that is relatively simplified in design and construction and at the same time offers sufficient structural characteristics so as to provide enhanced savings in heat loss and significantly reduce the number of repairs of replacements required and, accordingly, reduce the down time of such grate kilns and the like.

SUMMARY OF THE INVENTION

Pressure actuated sealing systems of the type hereinafter described have the advantages of a relatively simplified design and construction and at the same time offer sufficient structural characteristics so as to provide enhanced savings in heat loss and significantly reduce the number of required repairs or replacements and, accordingly, reduce the down time required of the grate kilns and the like with which they are used.

Broadly stated, the present invention contemplates the provision of a pressure actuated sealing system for a travelling grate comprising at least one horizontally elongated rigid seal plate pivotally mounted below said travelling grate in sealing relationship with said travelling grate and with windbox means mounted below said travelling grate, said travelling grate including a plurality of pallets each with seal plate engaging means and cavity means provided on the underside thereof, said seal plates being pivotable in the direction of movement of said travelling grate by engagement with said seal plate engaging means, said seal plate being pivotable in the direction opposite the direction of movement of said travelling grate by the pressure differential across said seal plate formed by the pressure of the gases within said windbox means on one side of said seal plate and the ambient pressure on the other side of said seal plate, said cavity means being adapted for permitting unobstructed pivotal movement of said seal plate in said opposite direction. Preferably the foregoing sealing system includes dead plate means mounted below said travelling grate in sealing relationship with said windbox means, the bottom horizontal edge of said seal plate being pivotally attached to said dead plate means. The foregoing sealing system also preferably includes means for limiting the extent of pivotal movement of said seal plate in the direction of said travelling grate, and means for limiting the extent of Pivotable movement of said seal plate in said opposite direction. The sealing system of the invention can be mounted in the interior of said windbox means, or exterior of said windbox means. Additionally, the foregoing sealing system can be mounted adjacent the downstream end of said windbox means or adjacent the upstream end of said windbox means.

It will be understood that terms such as "upstream" and "downstream", as well as "rearward" and "forward", herein designate relative directions with respect to the direction of movement of the travelling grate, the grate moving in a "downstream" or "forward" direction during normal operation.

Further, the present invention contemplates the provision of apparatus for the gaseous treatment of solid materials comprising: a travelling grate that includes a plurality of end-to-end abutting pallets, means for supporting said travelling grate, and means for advancing said travelling grate through a treatment zone wherein hot gases are passed through said travelling grate; windbox means mounted below said travelling grate adapted for receiving or transmitting said hot gases; and pressure actuated seal plate means pivotally mounted in sealing relationship with said windbox means and said travelling grate, the underside of each of said pallets including seal plate means engaging means and cavity means, said seal plate means being pivotable in the direction of movement of said travelling grate by engagement with said seal plate means engaging means, said seal plate means being pivotable in the direction opposite the direction of movement of said travelling grate by the pressure differential across said seal plate means formed by the hot gases in said windbox means on one side of said seal plate means and the ambient pressure on the other side of said seal plate means, said cavity means being adapted for permitting unobstructed pivotal movement of said seal plate means as it is pivoted in said opposite direction. Preferably the foregoing apparatus includes dead plate means mounted below said travelling grate in sealing relationship with said windbox means, said seal plate means further comprising at least one horizontally elongated rigid rectangular pivotal plate, the bottom horizontal edge of said pivotal plate being pivotally attached to said dead plate means. In a preferred embodiment, said windbox means includes a windbox member positioned in a heating zone of said apparatus, the pressure of the hot gases in said windbox member being less than said ambient pressure, said seal plate means being mounted exterior to said windbox member. Alternatively or additionally, said windbox means includes a windbox member positioned in a heating zone within said apparatus, the pressure of the hot gases in said windbox member being greater than said ambient pressure, said seal plate means being mounted within said windbox member. The foregoing apparatus can also include combinations of windbox members wherein said seal plate means is mounted adjacent the exterior of one or more of said windbox members and within one or more other windbox members of said apparatus. In a particularly advantageous embodiment the sealing system of the present invention is employed in a grate kiln.

BRIEF DESCRIPTION OF THE DRAWINGS

In the annexed drawings, like references indicate like parts or features.

DESCRIPTION OF THE PREFERRED EMBODIMENT

Figure 1:
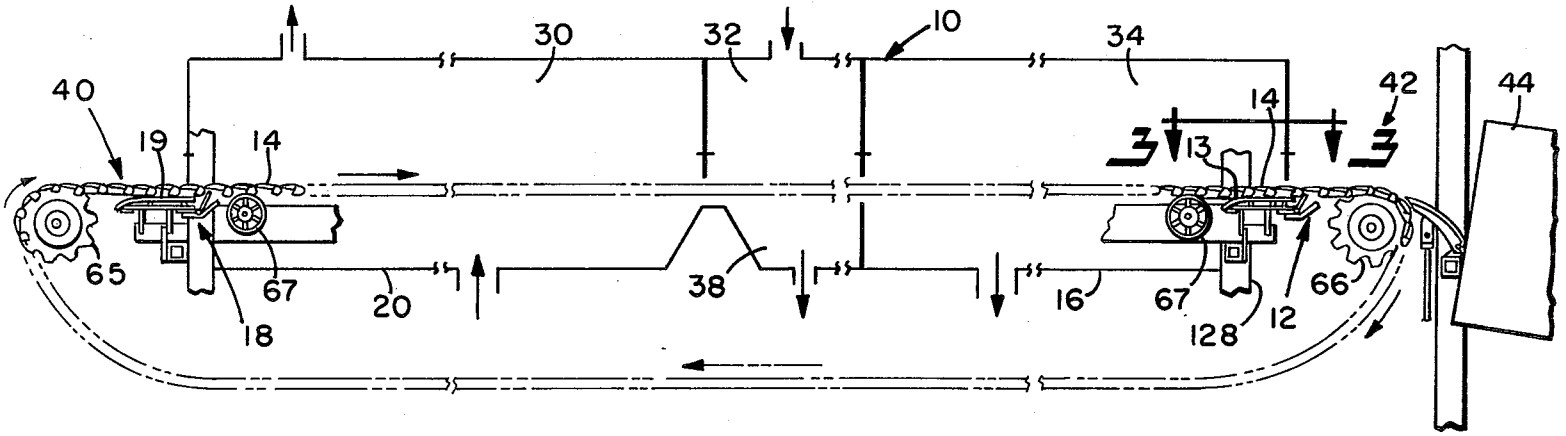
FIG. 1 is a schematic representation of a grate kiln in fragmentary, partially cut away side elevation illustrating the sealing system of the present invention in a particular form.

The sealing system of the present invention in its illustrated embodiment, as mounted, for example, for use in grate kiln 10, comprises (FIG. 1) an array of seal plate members 12 mounted on dead plates 13 below and extending across the width of travelling grate 14 in sealing relationship with travelling grate 14 and the downstream end of windbox 16, and an array of seal plate members 18 mounted on dead plates 19 below and extending across the width of travelling grate 14 in sealing relationship with travelling grate 14 and the upstream end of windbox 20, all as hereinafter further explained.

Grate kiln 10 includes an updraft drying zone 30, a downdraft drying zone 32 and a preheating zone 34. Windboxes 20 and 16 are positioned below travelling grate 14, and form a part of updraft drying zone 30 and preheating zone 34, respectively. Windbox 38 is positioned below travelling grate 14, and forms a part of downdraft drying zone 32. The material to be processed in grate kiln 10, which may be, for example, the above-discussed green balls, is deposited at the entrance 40 of grate kiln 10 on travelling grate 14, advanced through drying zones 30 and 32, and preheating zone 34, discharged from grate kiln 10 at discharge end 42 and deposited in rotary kiln 44 wherein it is subjected to further heat treatment. Grate kiln 10 and rotary kiln 44 are suitable, for example, for converting green balls to heat hardened pellets of sufficient strength and hardness for permitting such pellets to be handled, shipped, stored and charged into blast furnaces or other smelting apparatus. Grate kiln 10, rotary kiln 44 and process for making green balls and for converting such green balls into heat hardened pellets are entirely conventional and, accordingly, need not be further described herein.

Travelling grate 14 (FIG. 3) includes an array of parallel spaced continuous drive chains 50, 52, 54, 56, 58 and 60 which serve to support an array of successive courses of edge-abutting slotted pallets 62 which cooperatively define a continuous gas permeable medium for supporting the material to be processed in grate kiln 10. Chains 50, 52, 54, 56, 58 and 60 are interconnected by an array of horizontally elongated parallel spaced support rods 64 which extend across the width of travelling grate 14. The forward end of each of the pallets 62 is pivotally mounted on a rod 64, while the rearward end of each of the pallets 62 is supported by the forward end of the next rearwardly adjacent pallet 62. The chains 50, 52, 54, 56, 58 and 60 are driven by end wheels 65 and 66 and supported by an array of evenly spaced support wheels 67 which are provided throughout the length of travelling grate 14. Chains 50, 52, 54, 56, 58 and 60 ride on support members 70, 72, 74, 76, 78 and 80, respectively, which form part of the support structure of grate kiln 10. Three successive courses of pallets 62 are positioned between each of the drive chains 50, 52, 54, 56, 58 and 60. Accordingly, travelling grate 14 includes an array of 15 courses of pallets 62 extending across the width of the travelling grate 14. The courses of pallets 62 are interrupted by drive chains 52, 54, 56 and 58 which along with drive chains 50 and 60 are positioned in a common horizontal plane with pallets 62.

In the illustrated embodiment five of the seal plate members 12 are provided across the width of travelling grate 14. The five seal plate members 12 and the dead plates 13 associated with seal plate members 12 are positioned between drive chains 50 and 52, 52 and 54, 54 and 56, 56 and 58, and 58 and 60, respectively. For convenience, in FIG. 3, like parts or features of each of the seal plate members 12 as well as the dead plates 13 are identified by the same numeral, and the parts or features of each individual seal plate member 12 and dead plate 13 are identified with a common letter suffix from "a" to "e" corresponding to the individual seal plate member or dead plate. For example, the seal plate members 12 are identified from the bottom to the top of FIG. 3 as 12*a* to 12*e*, and like parts and features of each of the individual seal plate members 12*a* to 12*e* are identified by the same numeral while the parts and features of seal plate member 12*a*, for example, are identified by the letter suffix "a". Although not fully illustrated, the array of seal plate members 18 and dead plates 19 also has five members extending across the width of travelling grate 14. The plan view of the seal plate members 12*a* to 12*e* and dead plates 13*a* to 13*e* illustrated in FIG. 3 would be identical to the view that would be required to illustrate the five seal plate members 18 and five dead plates 19 extending across grate kiln 14. To facilitate the description of the preferred embodiment, numerals without letter suffixes are used in the following discussion.

Figure 3:
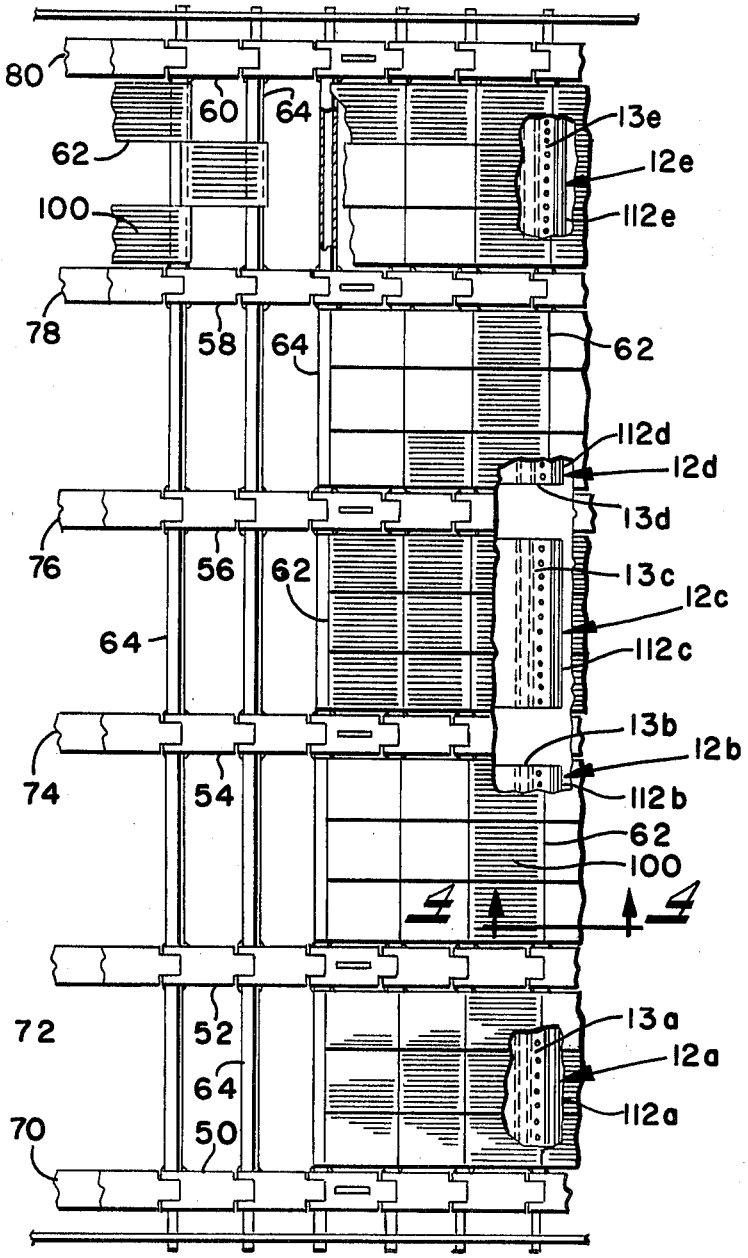
FIG. 3 is a fragmentary partially cut away top plan view taken along line 3—3 of FIG. 1.
Figure 4:
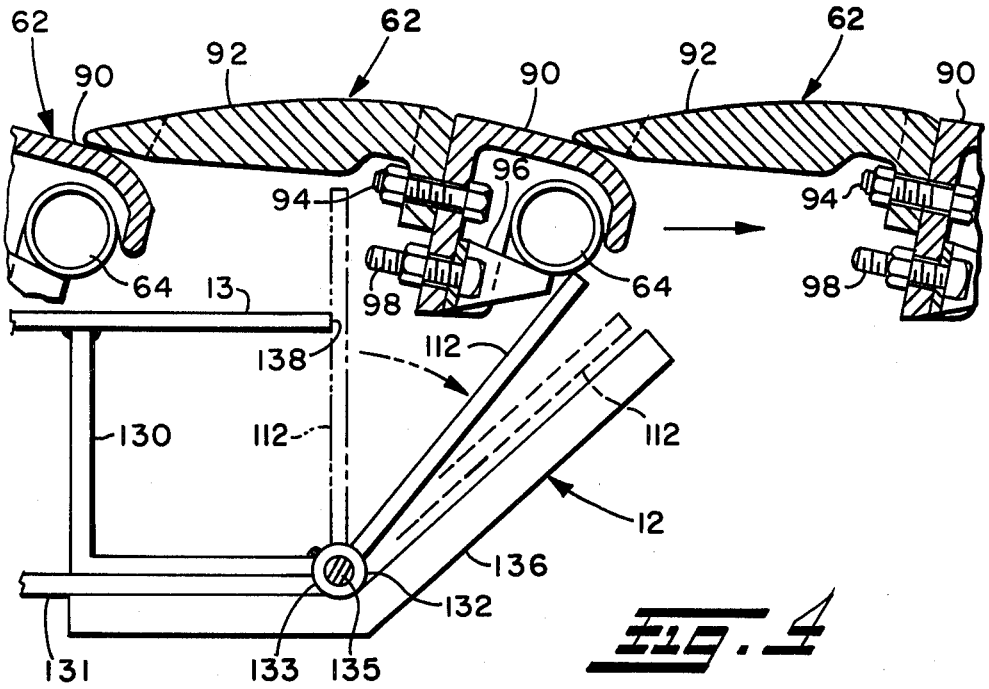
FIG. 4 is a cross-sectional side elevational view taken along line 4—4 of FIG. 3.

Each of the pallets 62, which are best illustrated in FIGS. 3 and 4, includes a forward cast section 90 and a rearward cast section 92 which are bolted together by a pair of bolts 94 (only one of the bolts 94 being shown in the drawings). Cast section 90 is bolted to mounting bracket 96 by a pair of bolts 98 (only one of the bolts 98 being shown in the drawing). Mounting bracket 96 is adapted for pivotal attachment to one of the support rods 64. Each of the cast sections 90 and 92 include an array of parallel spaced slots 100 extending longitudinally and through such sections. The open slots 100 are of sufficient size to permit the passage of hot treating gases through such slots, but are small enough so as not to permit appreciable quantities of the material being treated to fall through such slots.

The following description of the construction and operation of seal plate members 12 and dead plates 13 is alo applicable to seal plate members 18 and dead plates 19, since seal plate members 12 and 18 and dead plates 13 and 19 are respectively identical in design and construction. The only difference between seal plate members 12 and 18 is that seal plate members 12 are positioned exterior of windbox 16 adjacent the downstream end of windbox 16, while seal plate members 18 are positioned inside of windbox 20 adjacent the upstream end of windbox 20. Windbox 16 is adapted for operation at a negative pressure (e.g., about −15 inches of water) and since the ambient pressure on the downstream side of seal plate members 12 is at atmospheric pressure the gradient across seal plate members 12 biases seal plate members 12 to pivot in a counterclockwise direction, as illustrated in FIG. 1. On the other hand, windbox 20 is adapted for operation at a positive pressure (e.g., about +6 inches of water) and since the ambient pressure on the upstream end of seal plate members 18 is at atmospheric pressure, the pressure within windbox 20 biases seal plate members 18 to pivot in a counterclockwise direction as indicated in FIG. 1. The term "negative pressure" as used herein means less than atmospheric pressure, while the term "positive pressure" as used herein means greater than atmospheric pressure.

Figure 2:
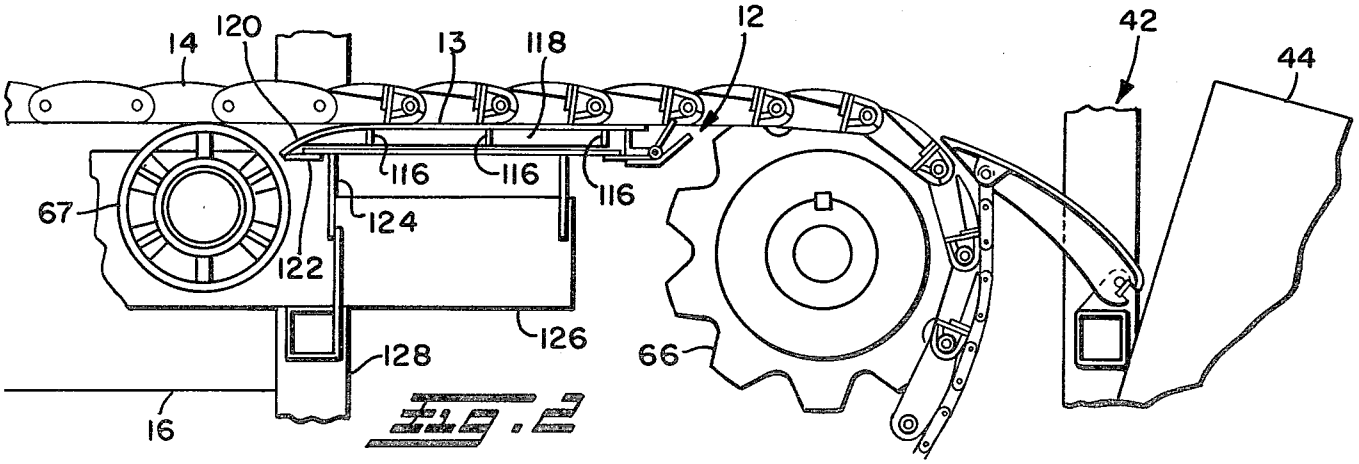
FIG. 2 is a fragmentary side elevational view of the discharge end of the sealing system of FIG. 1.

Seal plate members 12, which are best illustrated in FIGS. 2–4, are mounted on horizontally elongated, rigid rectangular dead plates 13. Each of the dead plates 13 includes an array of criss-crossing structural ribs 116 and 118 depending from its underside, ribs 116 extending transversely over the width of dead plate 13 and ribs 118 extending longitudinally over the length of dead plate 13. The upstream end of dead plate 13 includes downwardly curved section 120 and horizontally elongated strip 122 which is adapted for securing the upstream end of dead plate 13 to mounting bracket 124. Mounting bracket 124 is mounted on horizontal support beam 126 which in turn is supported by vertical support member 128 which forms part of the support structure of grate kiln 10. Horizontally elongated angle iron 130 is welded to and depends from the underside of the downstream end of dead plate 13. Angle iron 130 extends over the entire width of dead plate 13. Horizontally elongated strap 131 is bolted to the underside of angle iron 130 and is adapted for securing the downstream end of dead plate 13 to mounting bracket 124.

Each of the seal plate members 12 includes a horizontally elongated rigid rectangular pivotal plate 112 which is pivotally mounted on the downstream end of dead plate 13. Pivotal plate 112 is secured to dead plate 13 with hinge 132. Hinge 132 includes six pipe segments 133, three of which are welded to angle iron 130, the other three of such pipe segments 133 being welded to the bottom horizontal edge of pivotal plate 112. The pipe segments 133 welded to angle iron 130 alternate in sequence with those welded to pivotal plate 112. A hinge pin 135 extends through all six of the pipe segments, thereby pivotally securing the bottom horizontal edge of pivotal plate 112 to angle iron 130. A pair of back stop straps 136 (only one of which is shown in the drawings) are welded to the underside of strap 131 and project angularly upwardly and downstream. Straps 136 are adapted for limiting the clockwise pivotal movement of plate 112. The downstream edge 138 of dead plate 13 is adapted for limiting the counterclockwise pivotal movement of plate 112.

In operation, travelling grate 14 carries a bed of the material being processed (e.g., green balls) through grate kiln 10. Typically the depth of the bed is, for example, about seven inches. Windbox 16 is normally operated at a negative pressure (e.g., about −15 inches water) and the ambient pressure on the exterior of windbox 16 and on the downstream side of pivotal plate 112 is normally atmospheric pressure. The resulting pressure gradient across plate 112 biases plate 112 to a pivoted position against edge 138 of dead plate 13. The advancing movement of travelling grate 14 results in contacting engagement between plate 112 and cast section 90 of pallet 62. The advancing engaging movement of section 90 pivots plate 112 clockwise to a pivoted position overlying straps 136. As plate 112 reaches straps 136 plate 112 pivots to a sufficiently lowered position to provide clearance for cast section 90 of pallet 62 to pass over plate 112. After cast section 90 passes over plate 112, the biasing force caused by the pressure gradient over plate 112 causes plate 112 to pivot counterclockwise until it reaches edge 138 of dead plate 13. The open cavity under the underside 102 of cast section 92 permits the unobstructed counterclockwise pivotal movement of plate 112. The alternating clockwise and counterclockwise pivotal movement of plate 112 continues throughout the operation of grate kiln 10 as long as travelling grate 14 advances forwardly and windbox 16 is operated at a sufficiently negative pressure to provide sufficient pressure gradient to bias plate 112 to pivot counterclockwise. In the same regard, the pivotal movement of the plate 112 associated with seal plate member 18 continues throughout the operation of grate kiln 10 as long as travelling grate 14 advances forwardly and windbox 20 is operated at a sufficiently positive pressure to provide sufficient pressure gradient to bias plate 112 to pivot counterclockwise. An advantage of employing seal plate members 12 and 18 in grate kiln 10 is that substantial savings in fuel costs for heating grate kiln 10 are realized in comparison to operating grate kiln 10 without seal plate members 12 and 18, with or without dead plates 13 and 19.

While the invention has been explained in relation to its preferred embodiment, it is to be understood that various modifications thereof will become apparent to those skilled in the art upon reading this specification. Therefore, it is to be understood that the invention disclosed herein is intended to cover such modifications as fall within the scope of the appended claims.

I claim:

1. A pressure actuated sealing system for a travelling grate having a plurality of pallets each with an irregular bottom surface including a generally horizontal lower surface and a downwardly extending seal plate engaging means at the leading edge thereof, said system including a windbox mounted below said travelling grate for creating a pressure differential across said travelling grate, a dead plate disposed below said travelling grate, said seal plate engaging means sliding on said dead plate as said grate travels, a horizontally elongated rigid seal plate, and means for pivotably mounting said seal plate for pivoting movement about an axis parallel to and below said dead plate thereby to follow the bottom contour of the pallets, said seal plate pivoting upon engagement by said seal plate engaging means and against a pressure differential created by said windbox from a first angular position in which an edge of said plate is proximate said horizontal lower surface of said pallet to a second angular position in which said edge of said seal plate is more distant from said lower surface of said grate, said seal plate returning to said first angular position after passage of said seal plate engaging means, thereby to follow the irregular bottom surface of said pallets.

2. The system of claim 1 including means for limiting the extent of pivotal movement of said seal plate in the direction of said travelling grate.

3. The system of claim 1 with means for limiting the extent of pivotal movement of said seal plate in said opposite direction.

4. The system of claim 1 wherein said seal plate is mounted exterior of said windbox means.

5. The system of claim 1 wherein said seal plate is mounted in the interior of said windbox means.

6. The system of claim 1 wherein said seal plate is mounted adjacent the downstream end of said windbox means.

7. The system of claim 1 wherein said seal plate is mounted adjacent the upstream end of said windbox means.

8. The system of claim 1 with a plurality of said seal plates extending across the width of said travelling grate.

9. The system of claim 1 with five of said seal plates extending across the width of said travelling grate.

10. Apparatus for the gaseous treatment of solid materials comprising:

a travelling grate that includes a plurality of end-to-end abutting pallets; means for supporting said travelling grate; and means for advancing said travelling grate through a treatment zone wherein hot gases are passed through said travelling grate;

windbox means mounted below said travelling grate adapted for receiving or transmitting said hot gases; and pressure actuated seal plate means pivotally mounted in sealing relationship with said windbox means and said travelling grate; the underside of each of said pallets including seal plate means engaging means and cavity means extending upwardly from said seal plate engaging means; said seal plate means being pivotable in the direction of movement of said travelling grate by engagement with said seal plate means engaging means, said seal plate means being pivotable in the direction opposite the direction of movement of said travelling grate and into said upwardly extending cavity means by the pressure differential across said seal plate means formed by the hot gases in said windbox means on one side of said seal plate means and the ambient pressure on the other side of said seal plate means, said cavity means being adapted for permitting unobstructed pivotal movement of said seal plate means in said opposite direction.

11. The apparatus of claim 10 with dead plate means mounted below said travelling grate in sealing relationship with said windbox means, said seal plate means further comprising at least one horizontally elongated rigid rectangular pivotal plate, the bottom horizontal edge of said pivotal plate being pivotally attached to said dead plate means.

12. The apparatus of claim 11 wherein said seal plate means further comprises at least one back stop member for limiting the extent of pivotal movement of said pivotal plate in the direction of said travelling grate.

13. The apparatus of claim 11 wherein said dead plate means includes means for limiting the extent of pivotal movement of said pivotal plate in said opposite direction.

14. The apparatus of claim 10 wherein said seal plate means is mounted exterior of said windbox means.

15. The apparatus of claim 10 wherein said seal plate means is mounted in the interior of said windbox means.

16. The apparatus of claim 10 wherein said seal plate means is mounted adjacent the downstream end of said windbox means.

17. The apparatus of claim 10 wherein said seal plate means is mounted adjacent the upstream end of said windbox means.

18. The apparatus of claim 10 wherein said seal plate means comprises a plurality of seal plate members extending across the width of said travelling grate.

19. The apparatus of claim 18 with five of said seal plate members extending across the width of said travelling grate.

20. The apparatus of claim 10 wherein said treatment zone includes a preheating zone, said windbox means including a windbox member positioned in said preheating zone and the pressure of the hot gases in said windbox member being less than said ambient pressure, said apparatus including dead plate means mounted below said travelling grate in sealing relationship with the downstream end of said windbox member, said seal plate means comprising at least one horizontally elongated rigid rectangular plate mounted exterior of said windbox member with its bottom horizontal edge pivotally attached to said dead plate means.

21. The apparatus of claim 20 with a plurality of said rectangular plates extending across the width of said travelling grate, said dead plate means comprising a dead plate member for each of said rectangular plates.

22. The apparatus of claim 21 with five of said rectangular plates mounted across the width of said travelling grate.

23. The apparatus of claim 10 wherein said treatment zone includes a drying zone, said windbox means including a windbox member positioned in said drying zone and the pressure of said hot gases in said windbox member being greater than said ambient pressure, said apparatus including dead plate means mounted below said travelling grate in sealing relationship with the upstream end of said windbox member, said seal plate means comprising at least one horizontally elongated rigid rectangular plate mounted within said windbox member with its bottom horizontal edge pivotally attached to said dead plate means.

24. The apparatus of claim 23 with a plurality of said rectangular plates extending across the width of said travelling grate, said dead plate means comprising a dead plate member for each of said rectangular plates.

25. The apparatus of claim 24 with five of said rectangular plates mounted across the width of said travelling grate.

26. The apparatus of claim 10 wherein said treatment zone includes a preheating zone and a drying zone, said windbox means including a first windbox member positioned in said preheating zone, the pressure of the hot gases in said first windbox member being less than said ambient pressure, said apparatus including first dead plate means mounted below said travelling grate in sealing relationship with the downstream end of said first windbox member, said seal plate means comprising at least one first seal plate pivotally attached to said first dead plate means, and said windbox means including a second windbox member positioned in said drying zone, the pressure of said hot gases in said second windbox member being greater than said ambient pressure, said apparatus including second dead plate means mounted below said travelling grate in sealing relationship with the upstream end of said second windbox member, said seal plate means comprising at least one second seal plate pivotally attached to said second dead plate means.

* * * * *